US005863231A

United States Patent [19]

Strong et al.

[11] Patent Number: 5,863,231

[45] Date of Patent: Jan. 26, 1999

[54] UNDERWATER EXHAUST SYSTEM FOR MARINE ENGINE

[76] Inventors: Jeffrey W. Strong, 207 Elsa Rd., Jupiter, Fla. 33477; John R. Newton, 485 Royal Palm Way, Boca Raton, Fla. 33432

[21] Appl. No.: 858,546

[22] Filed: May 19, 1997

[51] Int. Cl.[6] ..... B63H 21/32

[52] U.S. Cl. ..... 440/89; 114/357

[58] Field of Search ..... 440/88, 89; 114/357, 114/67 A, 67 R; 181/235

[56] References Cited

U.S. PATENT DOCUMENTS

| | | | |
|---|---|---|---|
| 987,130 | 3/1911 | Geyer | 440/89 |
| 1,198,274 | 9/1916 | Reece | 440/89 |
| 5,329,074 | 7/1994 | Alexander | 440/89 |
| 5,505,644 | 4/1996 | Ousley, II et al. | 440/89 |
| 5,700,172 | 12/1997 | Ousley, II et al. | 440/89 |

*Primary Examiner*—Ed L. Swinehart
*Attorney, Agent, or Firm*—Michael Ebert

[57] ABSTRACT

An underwater exhaust system for a water-cooled marine engine installed in a boat whose hull is molded of fiber-reinforced resin. The system is adapted to exhaust underwater the gases and cooling water discharged from the engine via an internal fitting. The internal fitting is created by an exhaust port integral with the hull and formed of the same material, having a hydrodynamically-shaped main section defining a cavity whose mouth merges with the outer surface of the hull and an input section joined to the main section into which is fed the discharge from the engine. Telescoped into the cavity of the main section of the exhaust port and bonded thereto is a like-shaped main section of an external fitting having an output section joined to the main section to form an exhaust outlet from which the engine discharge is exhausted underwater.

5 Claims, 3 Drawing Sheets

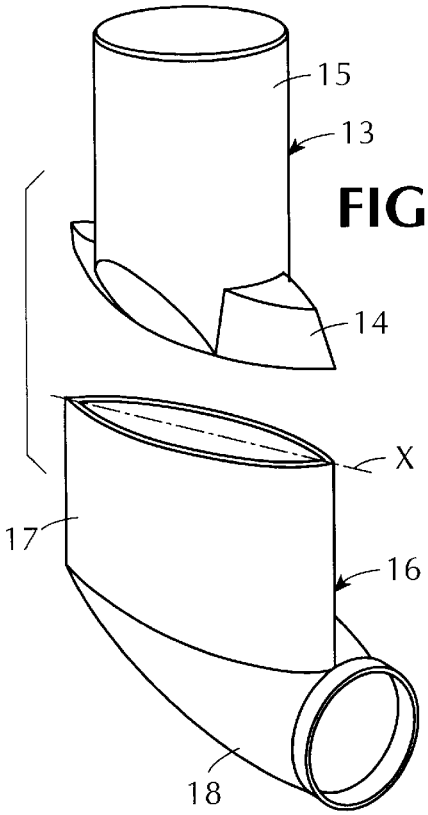
FIG. 1
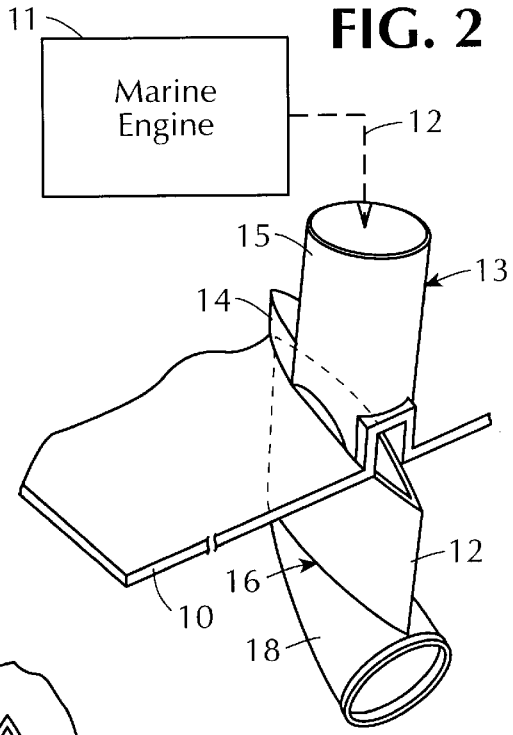
FIG. 2
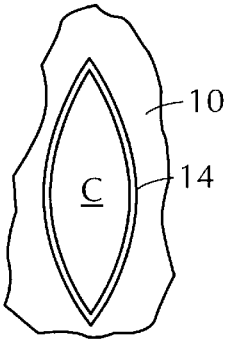
FIG. 1A
FIG. 3
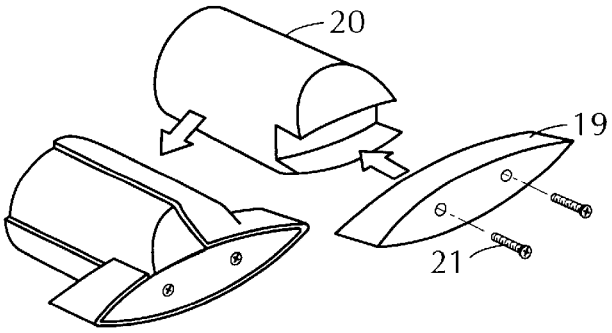
FIG. 4
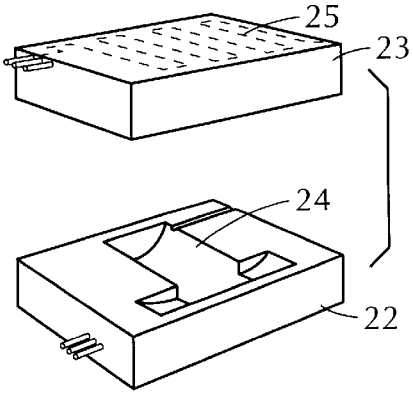

FIG. 5
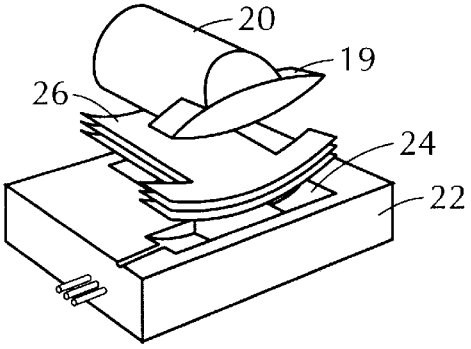
FIG. 6
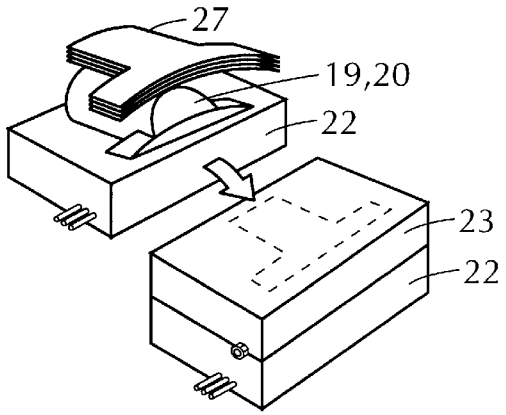
FIG. 7
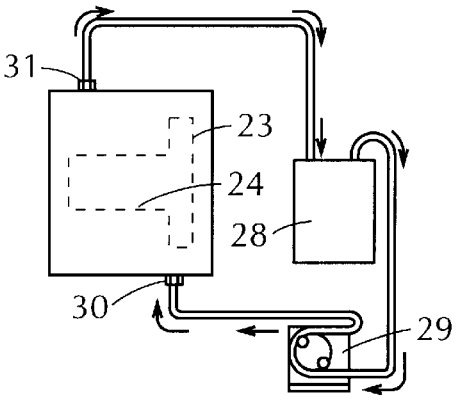
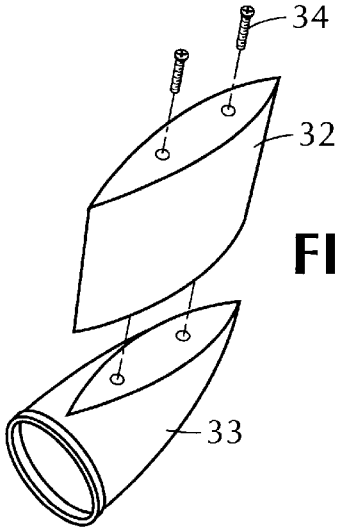
FIG. 8
FIG. 9
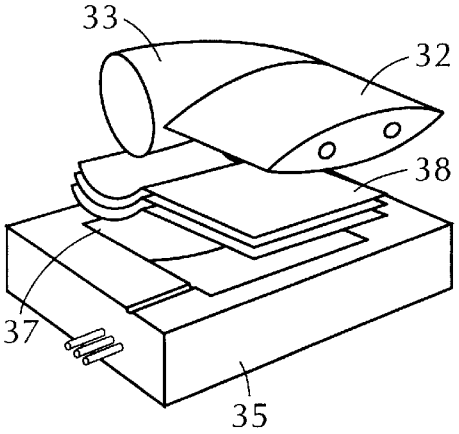
FIG. 10
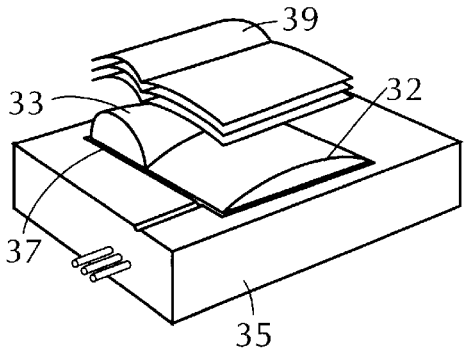

UNDERWATER EXHAUST SYSTEM FOR MARINE ENGINE

RELATED APPLICATION

This application is a continuation-in-part of our Strong et al. application Ser. No. 08/753,274, filed Nov. 22, 1996, now U.S. Pat. No. 5,756,034, granted May 26, 1998, 1996, entitled "MOLDED BOAT HULL HAVING IN SITU HOLES TO ACCOMMODATE THROUGH-HULL FITTINGS" whose entire disclosure is incorporated herein by reference.

BACKGROUND OF INVENTION

1. Field of Invention

This invention relates generally to underwater exhaust systems for marine engines, and in particular to a system installed in a boat whose hull is molded of fiber-reinforced resin, the system including an internal fitting that is integral with the hull and an external fitting telescoped in the internal fitting and extending from the hull to exhaust underwater the cooling water and gases discharged from the operating engine.

2. Status of Prior Art

To propel a boat, the boat machinery for this purpose consists principally of an onboard propulsion engine, a propeller and drive line components. Marine engines are almost exclusively of the familiar internal combustion types, gasoline or diesel. Gasoline engines have traditionally dominated the pleasure and sports boat field, while diesel engines are favored for commercial and military craft.

A typical marine engine includes a water cooling system; hence discharged from the operating engine are cooling water as well as exhaust gases. The boat therefore must be provided with an exhaust system for the discharge. An above water exhaust system for this purpose typically includes exhaust ports exiting through the transom of the boat.

Because of air passing around and behind the transom, exhaust gases are drawn into the cockpit, this being known, as the "station wagon effect." Even at idle, gases still linger at the stern of the boat. Moreover in a following breeze, gases are blown into the cockpit. Not only is the cockpit polluted by noxious exhaust gases, but engine noises are conveyed thereto by the exhaust system, and this makes the cockpit noisy.

A typical underwater exhaust system for a boat has a bronze fitting that is bolted to the hull and extends therefrom into the water. Should the bronze fitting extending From the hull be struck by an object, the fitting itself may not break off, thereby ripping a large hole in the hull with serious consequences.

Motor-driven sports and pleasure boats having hulls molded of fiberglass-reinforced resin are now commonplace. Such hulls must include through-fittings, such as one to accommodate the propeller shaft extending from the engine installed in the boat. And the hull must also include a fitting for an underwater exhaust system for the cooling water and gases discharged from the engine. If this exhaust system is of the conventional type, then it suffers from the above-noted drawbacks.

In our copending Strong et al. application above-identified, there is disclosed a molded fiberglass-reinforced resin boat hull provided with in situ holes to accommodate through-hull fittings, such as a fitting adapted to receive a rudder post.

This boat hull is molded on a female mold having locating holes drilled therein in registration with the holes to be formed in the hull. Anchored by a bolt locked in each locating hole is a plug of non-stick material, such as UHMW polyethylene, which projects above the female mold and has a configuration defining the hole to be formed in situ in the hull. Laid down on the female mold and about the projecting plugs are the reinforcing fiberglass materials which are impregnated with a flowable uncured resin for creating the hull. When the resin is cured, it is not bonded to the plugs whose anchoring bolts are removed to expose the in situ holes. The finished hull is then withdrawn from the female mold. In the case of the in situ hole for receiving a through-hull fitting for a rudder port, the in situ hole for this purpose has an internally-threaded cylindrical extension into which the externally-threaded rudder port is received.

In an underwater exhaust system in accordance with the invention, the system includes an exhaust port formed by an internal fitting which is integral with the molded fiber-reinforced hull. This internal fitting is produced in a manner similar to that in which in situ holes in a molded hull are created in our Strong et al. co-pending application.

SUMMARY OF INVENTION

In view of the foregoing, the main object of the invention is to provide an underwater exhaust system for a water-cooled marine engine installed in a boat whose hull is molded of fiber-reinforced resin, the system functioning to exhaust underwater the gases and cooling water discharged from the engine through an internal fitting integral with the hull.

More particularly, an object of this invention is to provide a system of the above type which includes an external fitting that is telescoped into the internal fitting whereby the cooling water and gases discharged from the engine and fed into the internal fitting are exhausted underwater through the external fitting.

Also an object of the invention is to provide a system of the above type whose external fitting has a hydrodynamic shape which acts to draw out the discharge from the marine engine the faster the boat goes.

Among the advantages of an underwater exhaust system for a water-cooled marine engine installed in a boat whose hull is molded of fiber-reinforced resin are the following:

A. the system eliminates "station wagon" effects, for no exhaust gas finds its way into the cockpit of the boat, nor are noises from the engine conveyed by the exhaust system into the cockpit.

B. The internal and external fittings of the exhaust system are molded of the same fiber-reinforced resin as that from which the hull is molded. Hence the materials forming the fittings are not dissimilar from those of the hull as in prior systems, and both fittings have the same temperature coefficients.

C. The internal fitting of the exhaust system is integral with the hull and is created in the process of molding the hull. The external fitting which is separately molded is easily installed, for it is shaped to telescope into a like-shaped section of the internal fitting.

D. The external fitting of the system is sacrificial in nature, for if this underwater fitting is struck by an object when the boat is advancing at high speed, the external fitting, despite its high structural strength, will shatter or break off without however inflicting damage on the hull. Should the external fitting be sheared from the hull, the discharge from the engine will then be exhausted from the mouth of the internal fitting which merges with the hull.

E. The positioning of the internal fitting on the molded boat hull is accurate from hull to hull, for the same female mold and an internal fitting form attached thereto is used in producing a hull having an internal fitting integral therewith.

Briefly stated, these objects are attained by an underwater exhaust system for a water-cooled marine engine installed in a boat whose hull is molded of fiber-reinforced resin. The system is adapted to exhaust underwater the gases and cooling water discharged from the engine via an internal fitting.

The internal fitting is created by an exhaust port integral with the hull and formed of the same material, having a hydrodynamically-shaped main section defining a cavity whose mouth merges with the outer surface of the hull and an input section joined to the main section into which is fed the discharge from the engine. Telescoped into the cavity of the main section of the exhaust port and bonded thereto is a like-shaped main section of an external fitting having an output section joined to the main section to form an exhaust outlet from which the engine discharge is exhausted underwater.

BRIEF DESCRIPTION OF DRAWING

For a better understanding of the invention as well as other objects and further features thereof, reference is made to the following detailed description to be read in conjunction with the accompanying drawings, wherein:

FIG. 1 is a perspective view of the internal and external fittings of an underwater exhaust system in accordance with the invention;

FIG. 1A is a bottom view of the main section of the internal fitting;

FIG. 2 shows the hull of a boat having a marine engine and the exhaust system installed on the hull;

FIG. 3 illustrates the manner by which a molding core is formed having the shape of the internal fitting;

FIG. 4 shows a two-part mold having a cavity shaped to accommodate the molding core and fiber-reinforcing layers for molding the internal fitting;

FIG. 5 shows how bottom layers of fiberglass are laid down in the mold cavity, the molding core for the internal fitting then resting on these bottom layers in the cavity;

FIG. 6 shows top layers of fiberglass being placed over the molding core, after which the mold is closed;

FIG. 7 shows how resin is injected into the closed mold to produce the internal fitting;

FIG. 8 shows how a molding core is formed having the shape of the external fitting;

FIG. 9 illustrates how bottom layers of fiberglass are laid down in the mold cavity, the molding core for the external fitting being placed over these bottom layers;

FIG. 10 illustrates the manner by which the top layers of fiberglass are placed over the molding core for the external fitting;

DESCRIPTION OF INVENTION

The Underwater Exhaust System

Figure 11:
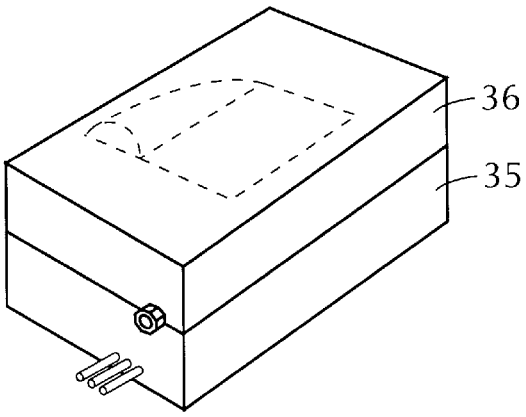
FIG. 11 shows the two part mold for molding the external fitting in its closed state before resin is injected therein.

Referring now to FIGS. 1, 1A and 2, shown in these figures is an underwater exhaust system in accordance with the invention installed in a boat whose hull 10 is molded of fiber-reinforced resin. Mounted within the boat is a marine engine 11 which is water cooled so that when the engine is in operation, it discharges raw cooling water and gases exhausted from its internal combustion engine.

The raw cooling water and gases discharged from engine 11 are conducted by a line 12 to an internal fitting 13 of the underwater exhaust system. Fitting 13 which functions as an exhaust port is molded of the same material as that of hull 10 and is integral therewith. Internal fitting 13 is constituted by a hydrodynamically-shaped main section 14 having a like shaped internal cavity C whose mouth merges with the outer surface of hull 10. Main section 14 is joined to a tubular input section 15 to which line 12 is coupled. Head the discharge from marine engine 11 passes into main section 14 of the exhaust port.

Associated with internal fitting 13 of the exhaust system is an external fitting 16 which functions as an exhaust outlet to exhaust into the sea the gases and cooling water discharged from the engine.

External fitting 16 which is preferably molded of the same fiber-reinforced resin as the internal fitting 13, includes a main section 17 having a hydrodynamic shape which complements that of the main section 14 of the internal fitting whereby main section 17 can be snugly telescoped into the similarly shaped main section 14 of the internal fitting, and then be permanently adhesive-bonded thereto, as by an epoxy resin or other waterproof.

Main section 17 of external fitting 16 is joined to a tubular output section 18 which is oriented to exhaust the engine discharge rearwardly form the external fitting.

Longitudinal axis X of the hydrodynamically-shaped main section of the underwater external fitting 16 is parallel to the longitudinal or keel axis of the boat. Hence as the boat advances in the water, the water stream impinges on and is divided by main section 17 of the external fitting which because of its hydrodynamic shape offers little resistance to the water-stream. Therefore, the divided flow along the surface of main 17 section is smooth and free of turbulence. And the divided flow of seawater behind external fitting 16 creates a negative pressure at the rear of outlet section 18 which acts to suck the cooling water and gases therefrom. Thus the faster the speed of the boat, and the greater the discharge from the engine propelling the boat, the greater is the negative pressure and the resultant force sucking the gases discharged and cooling water from the outlet.

It is desirable that the gases exhausted into the seawater bubble to the surface of the water as far as possible from the stern of the boat, so that these gases are not entrained by wind to blow back into the cockpit of the boat. The length and depth of external fitting 16 are such as to cause the exhaust gases to bubble to the water surface well aft of the boat.

Because external fitting 16 which is molded of fiber-reinforced resin is not integral with hull 10, but is telescoped into the main section of internal fitting 13 which is integral with the hull, the external fitting is sacrificial in nature. If therefore while the boat is underway, external fitting 16 is then struck by an underwater object, the structurally-strong external fitting will normally survive this experience. However, if the boat is going fast, and the object is large, the impact of the object on the external fitting may have sufficient force to shatter the external fitting or break it off.

Then that portion of main section 17 of the external fitting which is telescoped within and bonded to main section 14 of the internal fitting remains therein. But the broken remainder of main section 17 is swept away in the water. This action will not damage hull 10, and the gases and cooling water will then exhaust into the sea water discharged from the engine from the mouth of internal fitting 13 which merges with the outer surface of hull 10.

The sacrificial character of the external fitting is a significant feature of the invention. In prior art underwater exhaust systems in which the exhaust port is a metal fitting bolted to a fiber-reinforced molded resin hull, should this fitting which extends below the hull be struck with high impact force by an underwater object, the fitting itself would survive, but it would act to rip a hole in the reinforced plastic hull, with possibly serious consequences.

Molding of Internal Fitting

The fiber-reinforced resin from which hull 10 is molded may include fibers of fiberglass, graphite or other reinforcing fibrous materials. And the resin which when in an uncured, flowable state wets the fibers may be a polyester, a vinyl epoxy or an epoxy resin. When this resin is cured, the resultant fiber-reinforced resin hull has exceptionally high structural strength.

The internal fitting and the external fitting in an underwater exhaust system in accordance with the invention are both molded of the same material as that of the molded hull.

The first step in producing an internal fitting 13 of the type shown in FIG. 1 which is formed of a fiber-reinforced resin is to produce a plug or molding core as shown in FIG. 3 formed of a non-stick material to which a resin will not adhere. Suitable for this purpose is a plug of UHMW (ultra-high-molecular weight) polyethylene.

The molding core is made of two UHMW pieces 19 and 20 which are held together by removable screws 21. The pieces are so shaped that piece 19 has the hydrodynamic shape of main section 14 of internal fitting 13, while piece 20 has the cylindrical shape of input section 15 of this fitting.

To mold the internal fitting, provided for this purpose, as shown in FIG. 4, is a mold having complementary lower and upper sections 22 and 23, and a mold cavity 24 whose shape and size match those of internal fitting 13 to be molded therein. The mold sections are provided with cooling lines 25 to assist in curing the resin injected into the mold. In practice, the mold is preferably fabricated of polymeric concrete or other durable material so that it is possible to use the same mold to cast a large number of internal fittings.

As shown in FIG. 5, before putting the molding core formed by plug 19–20 into cavity 24 of the mold, three superposed sheets 26 of biaxial 45 degree E-glass fibers are laid down in the bottom of cavity 24. These sheets are cut to extend several inches beyond the edges of the cavity so as to conform the contours of the molding core. Then as shown in FIG. 6, after the core formed by pieces 19–20 is placed over the bottom three fiberglass sheets, three upper fiberglass sheets 27 are placed over the plug and the mold is then closed. The three upper sheets 27 are also cut to extend several inches beyond the edges of the cavity.

Injected under pressure into the cavity of the closed mold 22–23 as shown in FIG. 7, is a flowable epoxy resin drawn from a tank 28 by a peristaltic pump 29. To do this, the mold is stood on end so that inlet fitting 30 for the mold is at the bottom and outlet fitting 31 is at the top to provide a return path to tank 28.

This closed circuit injection system removes all air from between the core sections and the mold cavity by recycling the resin from the tank leaving the fiber/resin combination free of bubbles and voids.

The resin is allowed to cure in a temperature-controlled environment, thereby bonding all fibers in the resin into one single seamless part. The resultant internal fitting 13 with the molding core 19–20 therein is then removed from the mold and the flashing is trimmed.

The internal fitting produced in the mold is not in final form, for the fiber-reinforced resin shell of this fitting, in the course of molding a hull of the same material combined with the material of the hull and thereby integrated with the hull.

Molding of External Fitting

In order to mold the external fitting which as shown in FIG. 1, has a hydrodynamically shaped main section 17 and an outlet section 18 which is tubular, it is necessary to produce a molding core of UHMW polyethylene having the same shape.

The core or plug as shown in FIG. 8, has a hydrodynamically-shaped solid piece 21 whose shape is the same as that of main section 17 in FIG. 1 and solid piece 33 whose shape is the same as that of outlet section 18. As in the case of the molding core for the internal fitting, the molding core formed by pieces 32 and 33, held together by removable screws 34, has dimensions corresponding to those of the inner hollow of external fitting 16 shown in FIG. 1, for the external fitting formed of fiber-reinforced resin is molded about core 32–33.

As shown in FIGS. 9, 10 and 11, the two part mold for producing the external fitting has complementary lower and upper sections 35 and 36 and a mold cavity 37 whose shape conforms to that of the external fitting. Placed at the bottom of the cavity are three superposed sheets 38 of fiberglass, core 32–33 being placed over these sheets, as shown in FIG. 9.

And after the core is placed in the cavity, then three superposed sheets 39 of fiberglass are placed over core 32–33, as shown in FIG. 10. Then the mold is closed, as shown in FIG. 11, and flowable resin is injected therein in the same manner as previously described in connection with the closed mold for producing the internal fitting.

When the external fitting molded about the two piece core 32–33 is removed from the mold, the core is then withdrawn from the fitting by taking out screws 34 to separate the piece so they can be pulled out of the fitting. The hollow external fitting then has its flashing trimmed to put the fitting in condition for installation.

Molding of Hull

Figure 12:
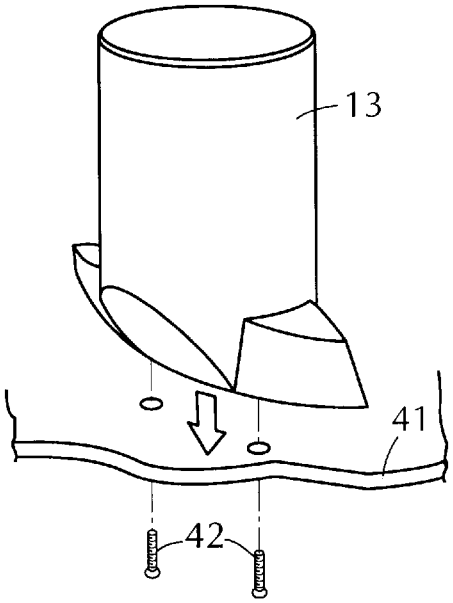
FIG. 12 shows how the molded internal fitting containing a two-piece molding core is attached to the female mold for molding the hull.

The hull 10 shown in FIG. 1 is molded on a female mold in the manner disclosed in the above-identified copending patent application. In order to integrate internal fitting 13 with the hull, the molded internal fitting formed of reinforced resin which comes out of the mold in FIG. 7 with the molding core therein, is attached by screw 40 to female mold 41, as shown in FIG. 12, at a site appropriate to the underwater exhaust system to be installed on the hull to be molded on the female mold.

Figure 13:
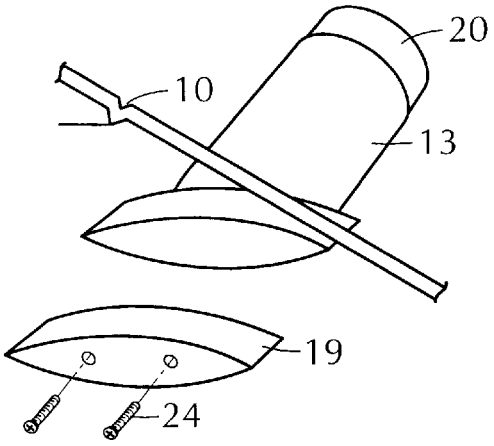
FIG. 13 shows how the two pieces of the molding core for the internal fitting are withdraw after the internal fitting is integrated with the hull of the boat.

Once the internal fitting and its molding core are in place on the female mold, then normal lay-up begins in the manner set forth in the copending application. Layers of fiberglass fabric are cut to go over the surface of the female mold and to go over and around the internal fitting attached to the female mold. Then the fabric fiberglass is wetted with a flowable uncured resin and the resin is cured, the resultant fiber-reinforced resin hull 10, as shown in FIG. 13 has integral therewith the fiber reinforced resin internal fitting 13 with the core formed by pieces 19 and 20 still inside the fitting. These pieces are removed from external fitting 13 by unscrewing screws 21, as shown in FIG. 13.

Figure 14:
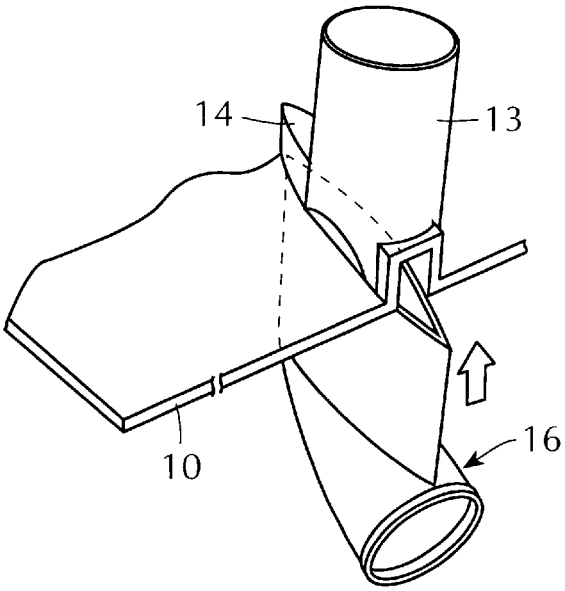
FIG. 14 shows the finished internal and external fittings of the exhaust system associated with the hull of the boat.

The final step, as shown in FIG. 14, now that hull 10 having the internal fitting 13 integral therewith is finished, is to telescope into the cavity of the main section of the internal fitting, the like-shaped main section of external fitting 16 and bonding these sections together, thereby completing the installation.

It is desirable that molded hull 10, internal fitting integral 13 with the hull, and the external fitting 16 joined to the internal fitting, all be fabricated of the same fiber-reinforced resin. In this way all components of the underwater exhaust system have the same properties and behave in the same manner under changing conditions of temperature and other variables to which the boat is subjected.

While there have been shown a preferred embodiment of an underwater exhaust system for a marine engine in accordance with the invention, it will be appreciated that many changes may be made therein without departing from the spirit of the invention.

We claim:

1. An underwater exhaust system included in a boat having a molded hull, said boat having installed therein a water-cooled marine engine whose discharge is constituted by exhaust gases and cooling water, said exhaust system which feeds the discharge from the boat underwater comprising:

A. a hollow internal fitting integrated with the hull provided with a hydrodynamically shaped main section defining a cavity having an open mouth which merges with the surface of the hull to create an exhaust port, and an input section joined to the main section which extends into the boat into which is fed the engine discharge; and B. a hollow external fitting having a main section whose shape corresponds to that of the main section of the internal fitting and is telescoped therein, and an output section joined thereto from which the discharge emerges underwater, the main section of the external fitting having a hydrodynamic shape which causes water to flow smoothly past this section on either side thereof and to create at the rear of the output section a negative pressure sucking the discharge out of the output section, said external fitting which is telescoped into the internal fitting integrated with the hull being a sacrificial component of the exhaust system whereby should the external fitting when the boat is underway be struck by an underwater object, it will break off and the exhaust gases and cooling water will then be discharged underwater by the internal fitting.

2. A system as set forth in claim 1, in which the boat hull is molded of fiber-reinforced resin.

3. A system as set forth in claim 2, in which the internal fitting is molded of the same fiber-reinforced resin and is integrated with the hull.

4. A system as set forth in claim 3, in which the external fitting is molded of the same fiber-reinforced resin.

5. A system as set forth in claim 2, in which the resin is reinforced by fiberglass.

* * * * *